US009183784B2

(12) United States Patent
Kwon et al.

(10) Patent No.: US 9,183,784 B2
(45) Date of Patent: Nov. 10, 2015

(54) DISPLAY DEVICE AND DRIVING METHOD THEREOF FOR COMPENSATING A THRESHOLD VOLTAGE DEVIATION CHARACTERISTIC OF THE DISPLAY

(71) Applicants: Oh-Kyong Kwon, Yongin (KR); Chang-Ho Hyun, Yongin (KR); Woung Kim, Yongin (KR)

(72) Inventors: Oh-Kyong Kwon, Yongin (KR); Chang-Ho Hyun, Yongin (KR); Woung Kim, Yongin (KR)

(73) Assignees: SAMSUNG DISPLAY CO., LTD., Yongin, Gyunggi-Do (KR); INDUSTRY-UNIVERSITY COOPERATION FOUNDATION HANYANG UNIVERSITY, Seoul (KR)

( * ) Notice: Subject to any disclaimer, the term of this patent is extended or adjusted under 35 U.S.C. 154(b) by 215 days.

(21) Appl. No.: 13/919,302

(22) Filed: Jun. 17, 2013

(65) Prior Publication Data

US 2014/0098082 A1 Apr. 10, 2014

(30) Foreign Application Priority Data

Oct. 5, 2012 (KR) ..... 10-2012-0110714

(51) Int. Cl.
*G09G 3/32* (2006.01)

(52) U.S. Cl.
CPC ..... *G09G 3/3291* (2013.01); *G09G 3/3233* (2013.01); *G09G 2300/0842* (2013.01); *G09G 2300/0861* (2013.01); *G09G 2300/0876* (2013.01); *G09G 2310/0297* (2013.01); *G09G 2320/0233* (2013.01)

(58) Field of Classification Search
CPC ..... G06G 3/3233; G09G 3/3291; G09G 2300/0842; G09G 2300/0861; G09G 2300/0876; G09G 2310/0297; G09G 2320/0233
See application file for complete search history.

(56) References Cited

U.S. PATENT DOCUMENTS

2006/0208976 A1* 9/2006 Ikeda ..... 345/76
2009/0115707 A1* 5/2009 Park et al. ..... 345/76

(Continued)

FOREIGN PATENT DOCUMENTS

JP 2001-324960 A 11/2001
JP 2006-285210 A 10/2006

(Continued)

OTHER PUBLICATIONS

Hai-Jung In, et al., "A Luminance Adjusting Algorithm for High Resolution and High Image Quality AMOLED Displays of Mobile Phone Applications", IEEE Transactions on Consumer Electronics, vol. 56, No. 3, Aug. 2010, pp. 1191-1195.

*Primary Examiner* — Allison Johnson
(74) *Attorney, Agent, or Firm* — Lee & Morse, P.C.

(57) ABSTRACT

A first reference voltage is applied to a plurality of pixels during a data writing period when data is written and a second reference voltage is applied to the plurality of pixels during a light emitting period when the plurality of pixels emit light, in which each of the plurality of pixels includes a switching transistor to transfer a data voltage applied to a data line to a first node; a driving transistor controlling a driving current flowing into an OLED according to the voltage of the first node and a first power supply voltage; and a storage capacitor including a first electrode connected to the first node and a second electrode receiving one of the first reference voltage and the second reference voltage. A difference between the first reference voltage and the second reference voltage is determined according to a threshold voltage deviation characteristic of the display unit.

16 Claims, 5 Drawing Sheets

(56) References Cited

U.S. PATENT DOCUMENTS

| | | | | |
|---|---|---|---|---|
| 2009/0207110 | A1* | 8/2009 | Lee et al. | 345/82 |
| 2010/0141644 | A1* | 6/2010 | Lee et al. | 345/76 |

FOREIGN PATENT DOCUMENTS

| | | | |
|---|---|---|---|
| KR | 10-2011-0044502 | A | 4/2011 |
| KR | 10-2011-0053709 | A | 5/2011 |

* cited by examiner

DISPLAY DEVICE AND DRIVING METHOD THEREOF FOR COMPENSATING A THRESHOLD VOLTAGE DEVIATION CHARACTERISTIC OF THE DISPLAY

CROSS-REFERENCE TO RELATED APPLICATION

This application claims priority under 35 U.S.C. to and the benefit of Korean Patent Application No. 10-2012-0110714 filed in the Korean Intellectual Property Office on Oct. 5, 2012, the entire contents of which are incorporated herein by reference.

BACKGROUND

1. Field

Embodiments relate to a pixel, a display device, and a driving method thereof, and, more particularly, to a display device capable of controlling an output range of a data driving IC and a driving method thereof.

2. Description of the Related Art

An organic light emitting diode display uses an organic light emitting diode (OLED) in which luminance is controlled by current or voltage. The organic light emitting diode (OLED) includes a positive electrode layer and a negative electrode layer forming an electric field and an organic light emitting material emitting light by the electric field.

Generally, organic light emitting diode (OLED) displays are classified into a passive matrix OLED (PMOLED) and an active matrix OLED (AMOLED) according to a mode driving the organic light emitting diode (OLED). The AMOLED devices that control light emission for each unit pixel are superior from the viewpoint of resolution, a contrast, and operation speed, and have become the most commonly used.

One pixel of the active matrix OLED includes an organic light emitting diode (OLED), a driving transistor controlling a current amount supplied to the organic light emitting diode (OLED), and a switching transistor transferring data voltage controlling a light emitting amount of the organic light emitting diode (OLED) as the driving transistor. The light emitting amount of the organic light emitting diode (OLED) is determined according to the current amount controlled by the driving transistor.

Image quality of a display panel may be determined according to how accurate the driving transistor included in each of a plurality of pixels controls the current amount according to the data voltage. However, threshold voltages of driving transistors substantially deviate due to precision limitation of a producing process. The threshold voltage deviation between the driving transistors included in one display panel may not be significant, while the threshold voltage deviation between driving transistors between different display panels may be significant. For example, the threshold voltage of the driving transistors in one display panel may be −1 V, while threshold voltage of the driving transistors in another display panel may be −4 V.

As one method for compensating the threshold voltage deviation of the driving transistor, the data driving IC may output data voltage in which a compensation value for compensating the threshold voltage deviation of the driving transistor is reflected to compensate the threshold voltage deviation of the driving transistor. However, the data voltage in which the compensation value is reflected may exceed an output range of the data driving IC. For example, the data voltage in which the compensation value is reflected in the display panel in which the threshold voltage is substantially −1 V may be within the output range of the data driving IC, but the data voltage in which the compensation value is reflected in the display panel in which the threshold voltage is substantially −4 V may exceed the output range of the data driving IC. When the data voltage in which the compensation value is reflected exceeds the output range of the data driving IC, the threshold voltage deviation of the driving transistor is not normally compensated and deterioration in image quality due to the threshold voltage deviation of the driving transistor may occur. In order to solve the problem, a data driving IC having a sufficiently wide output range needs to be used. However, the data driving IC having the wide output range increases power consumption and cost.

The above information disclosed in this Background section is only for enhancement of understanding of the background of the invention and therefore it may contain information that does not form the prior art that is already known in this country to a person of ordinary skill in the art.

SUMMARY

One or more embodiments are directed to providing a pixel, a display device, and a driving method thereof for controlling an output range of a data driving IC.

One or more embodiments are directed to providing a display device, including: a display unit including a plurality of pixels; and a reference voltage driver applying first reference voltage to the plurality of pixels for a data writing period when data are written in the plurality of pixels and applying second reference voltage to the plurality of pixels for a light emitting period when the plurality of pixels emit light, in which each of the plurality of pixels includes a switching transistor turned on by a scan signal of gate on voltage to transfer data voltage applied to a data line to a first node; a driving transistor controlling driving current flowing into an organic light emitting diode (OLED) according to the voltage of the first node and first power supply voltage; and a storage capacitor including one electrode connected to the first node and the other electrode to which any one of the first reference voltage and the second reference voltage is applied, and a reference voltage change value from the first reference voltage to the second reference voltage is determined according to a threshold voltage deviation characteristic of the display unit.

The threshold voltage deviation characteristic of the display unit may be an average value of threshold voltages of the driving transistors included in each of the plurality of pixels.

In the case where the driving transistor included in each of the plurality of pixels is a p-channel field effect transistor, the reference voltage change value may be determined so that a difference value between the reference voltage change value and the threshold voltage deviation characteristic of the display device has a predetermined value.

In the case where the driving transistor included in each of the plurality of pixels is an n-channel field effect transistor, the reference voltage change value may be determined so that the sum of the reference voltage change value and the threshold voltage deviation characteristic of the display device has a predetermined value.

The first reference voltage may be predetermined constant voltage.

The first reference voltage may be the same voltage as the first power source voltage.

Each of the plurality of pixels may further include a light emitting transistor turned on by a light emitting signal of gate on voltage to transfer the driving current to the organic light emitting diode (OLED).

At least one of the switching transistor, the driving transistor, and the light emitting transistor may be an oxide thin film transistor.

One or more embodiments are directed to providing a driving method of a display device including a plurality of pixels that includes a switching transistor transferring data voltage to a first node, a driving transistor controlling driving current flowing into an organic light emitting diode (OLED) according to voltage of the first node and first power supply voltage, and a storage capacitor connected between the first node and a reference voltage line, the method including: writing data by applying first reference voltage to the reference voltage line and turning on the switching transistor to transfer the data voltage to the first node; and emitting light by applying second reference voltage to the reference voltage line and allowing the organic light emitting diode (OLED) to emit light according to the driving current, in which a difference between the first reference voltage and the second reference voltage is determined according to a threshold voltage deviation characteristic of a display unit including the plurality of pixels.

The threshold voltage deviation characteristic of the display unit may be an average value of threshold voltages of the driving transistors included in each of the plurality of pixels.

The emitting of the light may include determining the reference voltage change value so that a difference value between the reference voltage change value and the threshold voltage deviation characteristic of the display device has a predetermined value, in the case where the driving transistor included in each of the plurality of pixels is a p-channel field effect transistor.

The emitting of the light may include determining the reference voltage change value so that the sum of the reference voltage change value and the threshold voltage deviation characteristic of the display device has a predetermined value, in the case where the driving transistor included in each of the plurality of pixels is an n-channel field effect transistor.

The writing of the data may include applying a data signal generated for a data writing period when the switching transistor is turned on to data lines connected to the plurality of pixels by using a 1:2 demux.

The emitting of the light may include turning on a light emitting transistor connected between the driving transistor and the organic light emitting diode (OLED) and transferring the driving current to the organic light emitting diode (OLED).

One or more embodiments are directed to providing a pixel, including: a switching transistor including a gate electrode connected to a scan line, one electrode connected to a data line, and the other electrode connected to a first node; a driving transistor including a gate electrode connected to the first node and one electrode connected to first power source voltage; a light emitting transistor including a gate electrode connected to a light emitting line, one electrode connected to the other electrode of the driving transistor, and the other electrode connected to an organic light emitting diode (OLED); and a storage capacitor including one electrode connected to the first node and the other electrode connected to a reference voltage line, in which the storage capacitor stores the data voltage as first reference voltage applied to the reference voltage line for a data writing period when the switching transistor is turned on to transfer data voltage to the first node, and changes gate voltage of the driving transistor by coupling as voltage applied to the reference voltage line for a light emitting period when the switching transistor is turned off and the light emitting transistor is turned on is changed from the first reference voltage to second reference voltage determined according to a deviation characteristic of threshold voltage of a display panel.

The threshold voltage deviation characteristic of the display panel may be an average value of threshold voltages of the driving transistors included in each of a plurality of pixels included in the display panel including the pixel.

In the case where the driving transistor included in each of the plurality of pixels is a p-channel field effect transistor, the second reference voltage may be determined so that a difference value between the reference voltage change value from the first reference voltage to the second reference voltage and the threshold voltage deviation characteristic of the display panel has a predetermined value.

In the case where the driving transistor included in each of the plurality of pixels is an n-channel field effect transistor, the second reference voltage may be determined so that the sum of the reference voltage change value from the first reference voltage to the second reference voltage and the threshold voltage deviation characteristic of the display panel has a predetermined value.

At least one of the switching transistor, the driving transistor, and the light emitting transistor may be an oxide thin film transistor.

DETAILED DESCRIPTION

Figure 1:
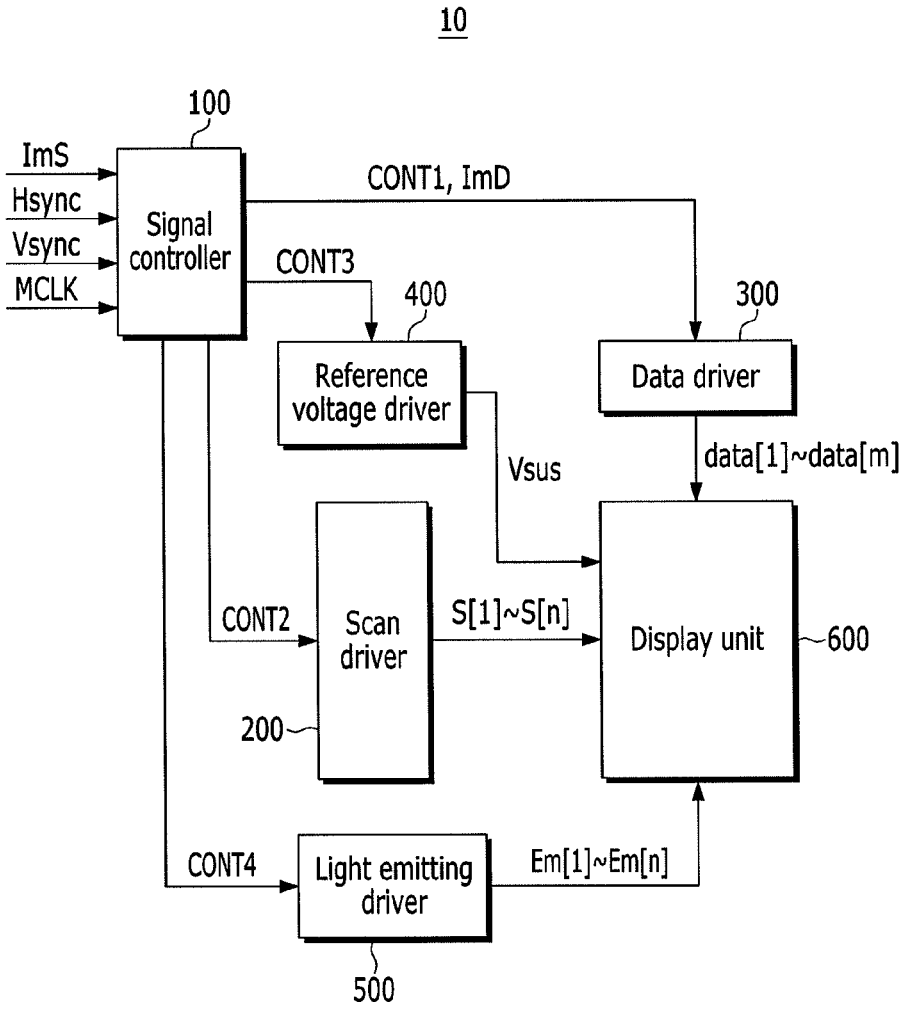
FIG. 1 is a block diagram illustrating a display device according to an exemplary embodiment.

Embodiments will be described more fully hereinafter with reference to the accompanying drawings. As those skilled in the art would realize, the described embodiments may be modified in various different ways, all without departing from the spirit or scope of the present disclosure.

Further, in exemplary embodiments, since like reference numerals designate like elements having the same configuration, a first exemplary embodiment is representatively described, and in other exemplary embodiments, only differences from the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. Further, unless explicitly described to the contrary, the word "comprise" and variations such as "comprises" or "comprising", will be understood to imply the inclusion of stated elements but not the exclusion of any other elements.

FIG. 1 is a block diagram illustrating a display device according to an exemplary embodiment. Referring to FIG. 1, a display device 10 includes a signal controller 100, a scan driver 200, a data driver 300, a reference voltage driver 400, a light emitting driver 500, and a display unit 600.

The signal controller 100 receives an image signal ImS and a synchronization signal input from an external device. The image signal ImS stores luminance information of a plurality of pixels. The luminance has a predetermined number of grays, for example, 1024(=$2^{10}$, 256(=$2^8$), or 64(=$2^6$) grays. The synchronization signal includes a horizontal synchronization signal Hsync, a vertical synchronization signal Vsync, and a main clock signal MCLK.

The signal controller 100 generates first to fourth driving control signals CONT1, CONT2, CONT3, and CONT4, and an image data signal ImD according to the image signal ImS, the horizontal synchronization signal Hsync, the vertical synchronization signal Vsync, and the main clock signal MCLK.

The signal controller 100 classifies the image signal ImS by a frame unit according to the vertical synchronization signal Vsync and classifies the image signal ImS by a scan line unit according to the horizontal synchronization signal Hsync to generate the image data signal ImD. The signal controller 100 transmits the image data signal ImD to the data driver 300 together with a first driving control signal CONT1.

The display unit 600 is a display area including the plurality of pixels. In the display unit 600, a plurality of scan lines which extends in a substantially row direction to be substantially parallel to each other, a plurality of data lines, which extends in a substantially column direction to be substantially parallel to each other, a plurality of reference voltage lines, and a plurality of light emitting lines are connected to the plurality of pixels. The plurality of light emitting lines, which extends in a substantially row direction to be substantially parallel to each other, may be connected to the plurality of pixels.

The scan driver 200 is connected to the plurality of scan lines and generates a plurality of scan signals S[1]-S[n] according to a second driving control signal CONT2. The scan driver 200 may sequentially apply the scan signals S[1]-S[n] of gate on voltage to the plurality of scan lines.

The data driver 300 is connected to the plurality of data lines, samples and holds the image data signal ImD according to the first driving control signal CONT1, and applies a plurality of data signals data[1]-data[m] to each of the plurality of data lines. The data driver 300 may apply data signals having a predetermined voltage range to the plurality of data lines in response to the scan signals S[1]-S[n] of the gate on voltage.

The reference voltage driver 400 is connected to the plurality of reference voltage lines and determines a level of reference voltage Vsus according to a third driving control signal CONT3 to apply the determined reference voltage Vsus to the plurality of reference voltage lines. That is, the reference voltage driver 400 may apply a first reference voltage Vsus1 of a first voltage level for a data writing period when data is written to the plurality of pixels and apply a second reference voltage Vsus2 of a second voltage level to the plurality of reference voltage lines for a light emitting period when the plurality of pixels emits light. In this case, a voltage difference ΔVsus between the second reference voltage Vsus2 and the first reference voltage Vsus1 is determined according to a threshold voltage deviation characteristic of the driving transistors of the plurality of pixels included in the display unit 600.

The light emitting driver 500 is connected to the plurality of light emitting lines and generates a plurality of light emitting signals Em[1]-Em[n] according to a fourth driving control signal CONT4. The light emitting driver 500 sequentially applies the light emitting signals Em[1]-Em[n] of the gate on voltage to the plurality of light emitting lines to allow the plurality of pixels to sequentially emit light. Further, the light emitting driver 500 simultaneously applies the light emitting signals Em[1]-Em[n] of the gate on voltage to the plurality of light emitting lines to allow the plurality of pixels to simultaneously emit light.

Figure 2:
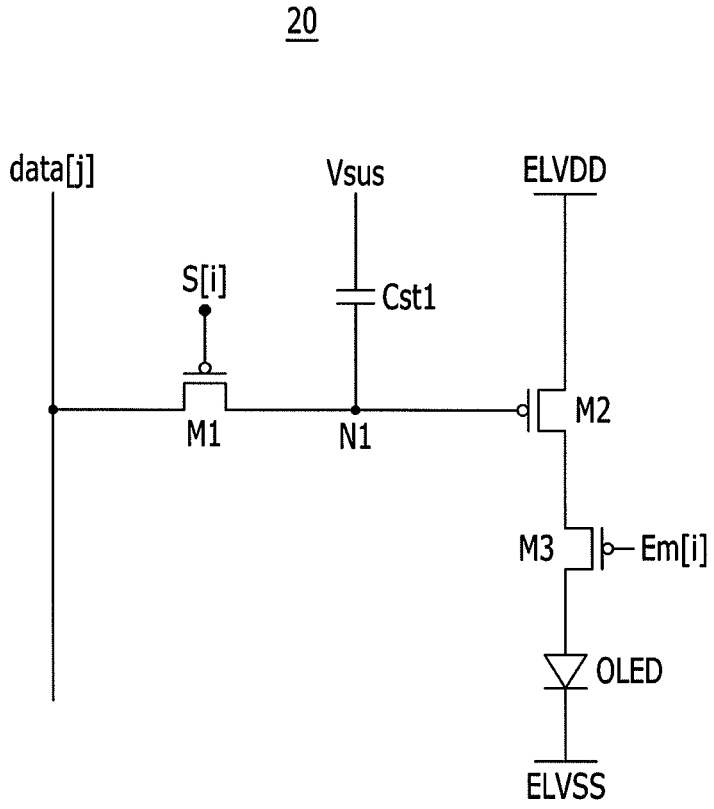
FIG. 2 is a circuit diagram illustrating a pixel according to the exemplary embodiment.

FIG. 2 is a circuit diagram illustrating a pixel according to the exemplary embodiment of the present invention. FIG. 2 illustrates any one pixel of the plurality of pixels included in the display device 10. Referring to FIG. 2, a pixel 20 includes a switching transistor M1, a driving transistor M2, a light emitting transistor M3, a storage capacitor Cst1, and an organic light emitting diode (OLED).

The switching transistor M1 includes a gate electrode connected to a scan line, a first electrode connected to a data line, and a second electrode connected to a first node N1. The switching transistor M1 is turned on by a scan signal S[i] of gate on voltage applied to the scan line to transfer a data signal data[j] applied to the data line to the first node N1.

The driving transistor M2 includes a gate electrode connected to the first node N1, a first electrode connected to first power source voltage ELVDD, and a second electrode connected to a first electrode of the light emitting transistor M3. The driving transistor M2 is turned on or off by a data signal data[j] transferred through the switching transistor M1 to control driving current flowing into the organic light emitting diode (OLED) from the first power source voltage ELVDD.

The light emitting transistor M3 includes a gate electrode connected to the light emitting line, the first electrode connected to the second electrode of the driving transistor M2, and a second electrode connected to an anode of the organic light emitting diode (OLED). The light emitting transistor M3 is turned on by a light emitting signal Em[i] of gate on voltage applied to the light emitting line to transfer driving current to the organic light emitting diode (OLED), and as a result, the organic light emitting diode (OLED) emits light.

The storage capacitor Cst1 includes a first electrode connected to the first node N1 and a second electrode connected to the reference voltage line. The storage capacitor Cst1 stores a data signal data[j] applied to the first node N1. When the reference voltage Vsus is changed for the light emitting period, voltage of the first node N1 is changed by coupling due to the storage capacitor Cst1.

The organic light emitting diode (OLED) includes an anode connected to the other electrode of the light emitting transistor M3 and a cathode connected to second power source voltage ELVSS. The organic light emitting diode (OLED) may emit one light of a primary color. Examples of primary colors may include three primary colors of red R, green G, and blue B, and a desired color may be displayed by a spatial sum or a temporal sum of the three primary colors.

The first power source voltage ELVDD is logic high level voltage and the second power source voltage ELVSS is logic low level voltage, and as a result, driving voltage required for pixel operation is supplied.

The switching transistor M1, the driving transistor M2, and the light emitting transistor M3 may be p-channel field effect transistors. In this case, gate on voltage turning on the switching transistor M1, the driving transistor M2, and the light emitting transistor M3 is logic low level voltage, and gate off voltage turning off the switching transistor M1, the driving transistor M2, and the light emitting transistor M3 is logic high level voltage.

Here, the p-channel field effect transistor is illustrated, but at least one of the switching transistor M1, the driving transistor M2, and the light emitting transistor M3 may be an n-channel field effect transistor. In this case, gate on voltage turning on the n-channel field effect transistor is logic high level voltage, and gate off voltage turning off the n-channel field effect transistor is logic low level voltage.

The switching transistor M1, the driving transistor M2, and the light emitting transistor M3 may be provided by any one of an amorphous silicon thin film transistor (amorphous-Si TFT), a low temperature poly-silicon (LTPS) thin film transistor, and an oxide thin film transistor (Oxide TFT). The oxide thin film transistor (Oxide TFT) may contain oxide, e.g., amorphous indium-gallium-zinc-oxide (IGZO), zinc-oxide (ZnO), and titanium oxide (TiO) as an active layer.

Figure 3:
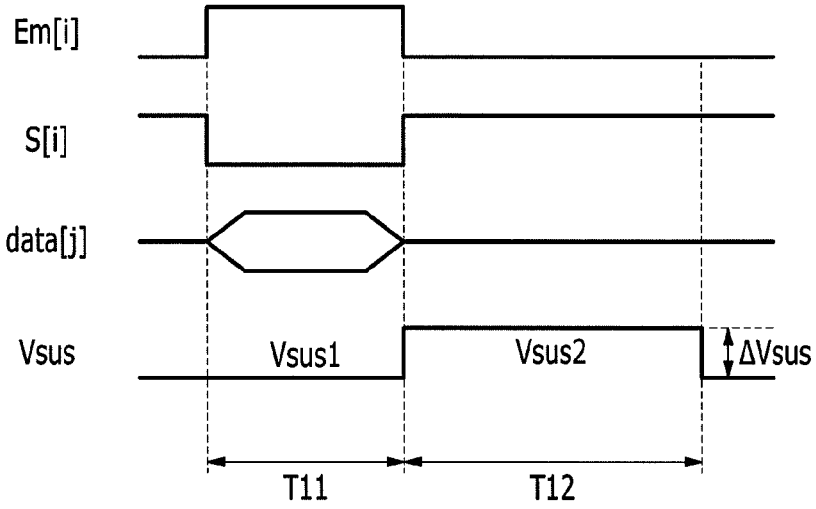
FIG. 3 is a timing diagram illustrating a driving method of the display device according to the exemplary embodiment.

FIG. 3 is a timing diagram illustrating a driving method of the display device according to the exemplary embodiment. Hereinafter, a driving method of the display device 10 will be described with reference to FIGS. 1 to 3.

Referring to FIGS. 1 to 3, a driving method of the display device 10 includes a data writing period T11 when a data signal data[j] is written in each pixel and a light emitting period T12 when each pixel emits light.

During the data writing period T11, the light emitting signal Em[i] is applied as logic high level voltage, a scan signal S[i] is applied to as logic low level voltage, and the reference voltage Vsus is applied as the first reference voltage Vsus1. In this case, the data signal data[i] is applied as data voltage Vdat of a predetermined voltage range. Since the light emitting signal Em[i] is applied as the logic high level voltage, the light emitting transistor M3 is turned off Since the scan signal S[i] is applied as the logic low level voltage, the switching transistor M1 is turned on. The data signal data[i] is transferred to the gate electrode of the driving transistor M2 through the turned-on switching transistor M1. The gate voltage of the driving transistor M2 becomes Vdat. Since the first reference voltage Vsus1 is applied to one electrode of the storage capacitor Cst1, voltage of Vsus1−Vdat is stored in the storage capacitor Cst1. Even though the driving transistor M2 is turned on by the data signal data[i], since the light emitting transistor M3 is turned off, current does not flow into the organic light emitting diode (OLED).

During the light emitting period T12, the light emitting signal Em[i] is applied as logic low level voltage, the scan signal S[i] is applied as logic high level voltage, and the reference voltage Vsus is applied as the second reference voltage Vsus2. Since the light emitting signal Em[i] is applied as the logic low level voltage, the light emitting transistor M3 is turned on. Since the scan signal S[i] is applied as the logic high level voltage, the switching transistor M1 is turned off Since the switching transistor M1 is turned off, the gate electrode of the driving transistor M2 is in a floating state. In this case, as the reference voltage Vsus is changed from the first reference voltage Vsus1 to the second reference voltage Vsus2, the gate voltage of the driving transistor M2 becomes Vdat+(Vsus2−Vsus1)=Vdat+ΔVsus due to coupling by the storage capacitor Cst1.

A voltage difference between the second reference voltage Vsus2 and the first reference voltage Vsus1, i.e., a change value ΔVsus of the reference voltage Vsus is determined according to a threshold voltage deviation characteristic of the driving transistors of the plurality of pixels included in the display unit 600. That is, when the first reference voltage Vsus1 is a predetermined constant voltage, e.g., the first power source voltage ELVDD, the second reference voltage Vsus2 is determined according to a threshold voltage deviation characteristic of the driving transistors of the plurality of pixels included in the display unit 600.

For the light emitting period T12, as the light emitting transistor M3 is turned on, driving current Ioled flows into the organic light emitting diode (OLED) to allow the organic light emitting diode (OLED) to emit the light. The driving current Ioled flowing into the organic light emitting diode (OLED) is the same as the following Equation 1.

$$Ioled = \frac{\beta}{2}(Vgs - Vth)^2 = \frac{\beta}{2}(ELVDD - Vdat - \Delta Vsus - Vth)^2 \quad \text{(Equation 1)}$$

Where Vgs is gate-source voltage of the driving transistor M2, Vth is an absolute value of the threshold voltage of the driving transistor M2, and β is a parameter determined according to a characteristic of the driving transistor M2.

As such, the driving current Ioled flowing into the organic light emitting diode (OLED) is determined by the data voltage Vdat, the change value ΔVsus of the reference voltage Vsus, and the threshold voltage Vth of the driving transistor M2.

The data voltage Vdat is voltage output in a predetermined voltage range which may be output by the data driver 300.

The threshold voltage Vth of the driving transistor M2 reflects the threshold voltage deviation characteristic depending on a display panel. The driving transistors in one display panel may have similar threshold voltages, while a difference between the threshold voltages between the driving transistors in different display panels may be significant. In this case, an approximately average value of the threshold voltages of the driving transistors included in the display panel is referred to the threshold voltage deviation characteristic of the corresponding display panel. For example, it is assumed that the threshold voltages of the driving transistors included in a first display panel are approximately −1 V, the threshold voltages of the driving transistors included in a second display panel are approximately −4 V. The threshold voltage deviation characteristic of the first display panel becomes −1 V, and the threshold voltage deviation characteristic of the second display panel becomes −4 V.

The change value ΔVsus of the reference voltage is determined depending on the threshold voltage deviation characteristic depending on the display panel, and as a result, the output range of the data driver 300 is controlled. The change value ΔVsus of the reference voltage may be determined so that sum of the change value ΔVsus of the reference voltage and the threshold voltage deviation characteristic depending on the display panel or a difference value therebetween has the same value for each display panel.

When the driving transistor is the p-channel field effect transistor, the threshold voltage deviation characteristic depending on the display panel has a negative value. In this case, the change value ΔVsus of the reference voltage may be determined so that a difference value between the change value ΔVsus of the reference voltage and the threshold voltage deviation characteristic depending on the display panel has a predetermined value, that is, the same value for each display panel. That is, the second reference voltage Vsus2 may be determined so that the difference value between the change value ΔVsus of the reference voltage and the threshold voltage deviation characteristic depending on the display panel has the same value for each display panel based on the predetermined constant first reference voltage Vsus1.

When the driving transistor is the n-channel field effect transistor, the threshold voltage deviation characteristic depending on the display panel has a positive value. In this case, the change value ΔVsus of the reference voltage may be determined so that the sum of the change value ΔVsus of the reference voltage and the threshold voltage deviation characteristic depending on the display panel has a predetermined value, that is, the same value for each display panel. That is, the second reference voltage Vsus2 may be determined so that the sum of the change value ΔVsus of the reference voltage and the threshold voltage deviation characteristic depending on the display panel has the same value for each display panel based on the predetermined constant first reference voltage Vsus1.

Table 1 illustrates an example simulating the output range of the data driver 300 by determining the change value ΔVsus of the reference voltage Vsus according to the threshold voltage deviation characteristic of the display panel.

TABLE 1

| | | Threshold voltage deviation characteristic | | | |
|---|---|---|---|---|---|
| | | −1 V | −2 V | −3 V | −4 V |
| Reference voltage change value (ΔVsus) | | 1.5 V | 1 V | 0 V | −1 V |
| Output range | Red pixel | 1.898-4.2 V | 1.355-3.3 V | 1.156-3.166 V | 0.971-3.023 V |
| | Green pixel | 1.698-4.0 V | 1.155-3.2 V | 0.951-3.02 V | 0.759-2.884 V |
| | Blue pixel | 0.589-3.4 V | 1.041-3.4 V | 0.839-3.17 V | 0.642-3.046 V |

In Equation 1, when the deviation characteristics of the threshold voltage are −2 V, −3 V, and −4 V, the change value ΔVsus of the reference voltage is set so that a value of −ΔVsus−Vth term is −3 V, and when the threshold voltage deviation characteristic is −1 V, the change value ΔVsus of the reference voltage is set so that a value of −ΔVsus−Vth term is −2.5 V. As a result, the output range of the data driver 300 in which a red pixel, a green pixel, and a blue pixel emit lights at 256 grays, respectively is decreased. When the threshold voltage deviation characteristic according to the display panel is −1 V to −4 V, the output range of the data driver 300 becomes 0.971 to 4.2 V with respect to the red pixel, 0.759 to 4.0 V with respect to the green pixel, and 0.589 to 3.4 V with respect to the blue pixel. Accordingly, the data driver 300 may use a driving IC having the output range of 0.589 to 4.2 V.

As described above, the change value ΔVsus of the reference voltage Vsus may be determined according to the threshold voltage deviation characteristic of the display panel to control the output range of the data driver 300. As a result, the data driver 300 may use a driving IC that does not influence the threshold voltage deviation characteristic of the display panel, i.e., does not correct for these variations, and does not unnecessarily have a wide output range, i.e., has a small output range.

Table 2 illustrates an example simulating an output range of the data driver 300 according to the threshold voltage deviation characteristic of the display panel, when the reference voltage Vsus is applied at the same voltage as the first power source voltage ELVDD for the data writing period T11 and the light emitting period T12.

TABLE 2

| | | Threshold voltage deviation characteristic | | | |
|---|---|---|---|---|---|
| | | −1 V | −2 V | −3 V | −4 V |
| Output range | Red pixel | 3.15-5.18 V | 2.15-4.18 V | 1.15-3.18 V | 0.15-2.18 V |
| | Green pixel | 2.95-5.02 V | 1.95-4.02 V | 0.95-3.02 V | −0.05-2.0 V |
| | Blue pixel | 2.83-5.21 V | 1.83-4.21 V | 0.83-3.21 V | −0.17-2.21 V |

As can be seen in Table 2, when the reference voltage Vsus is not changed, the output range of the data driver 300 becomes 0.15 to 5.18 V with respect to the red pixel, −0.05 to 5.02 V with respect to the green pixel, and −0.17 to 5.21 V with respect to the blue pixel. Accordingly, the data driver 300 may use a driving IC having the output range of −0.17 to 5.21 V.

In the case where the output range of the data driver 300 is controlled by determining the change value ΔVsus of the reference voltage Vsus according to the threshold voltage deviation characteristic of the display panel, the driving IC having the output range of 0.589 to 4.2 V may be used, while in the case where the first power source voltage ELVDD is applied as the reference voltage Vsus and is not changed, the driving IC having an output range of −0.17 to 5.21 V needs to be used.

That is, as the output range of the data driver 300 is controlled by determining the change value ΔVsus of the reference voltage Vsus according to the threshold voltage deviation characteristic of the display panel, the driving IC having a wide output range does not need to be used and the driving IC having the relatively small output range may be used.

Figure 4:
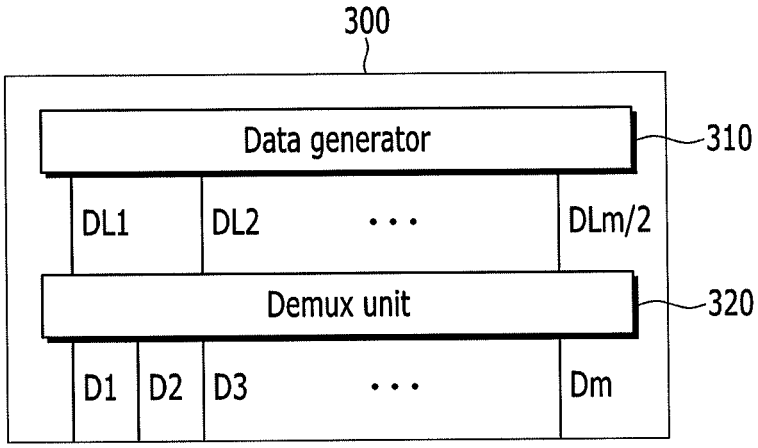
FIG. 4 is a block diagram illustrating a data driver according to the exemplary embodiment.

FIG. 4 is a block diagram illustrating a data driver according to the exemplary embodiment. Referring to FIG. 4, the data driver 300 includes a data generator 310 and a demux unit 320.

The data generator 310 is connected to m/2 first data lines DL1-DLm/2. The data generator 310 samples and holds an image data signal ImB according to the first driving control signal CONT1 and generates data signals data[1]-data[m]. The data generator 310 temporally distributes and applies m data signals data[1]-data[m] to the m/2 first data lines DL1-DLm/2.

The demux unit 320 demuxes the m data signals data[1]-data[m] input through the m/2 first data lines DL1-DLm/2 to apply the demuxed data signals to m second data lines D1-Dm. That is, the demux unit 320 may be 1:2 demux. The m second data lines D1-Dm are connected to the plurality of pixels.

Figure 5:
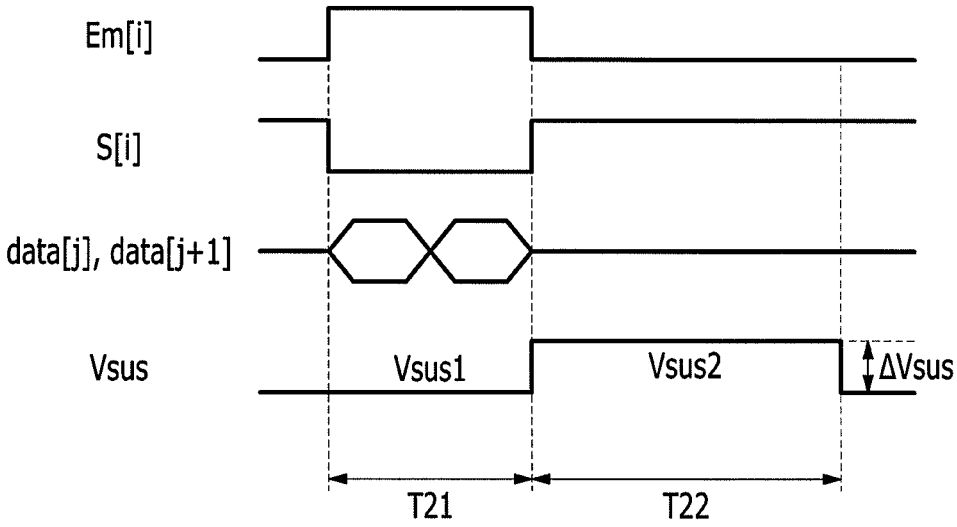
FIG. 5 is a timing diagram illustrating a driving method of a display device according to another exemplary embodiment.

FIG. 5 is a timing diagram illustrating a driving method of a display device according to another exemplary embodiment. Referring to FIG. 5, in the case where the data driver 300 includes the data generator 310 and the demux unit 320 as illustrated in FIG. 4, a driving method of the display device 10 is illustrated. Differences from the driving method of the display device 10 of FIG. 3 will be described.

During a data writing period T21, when the scan signal S[i] is applied as logic low level voltage, the data generator 310 first outputs m/2 data signals of the m data signals data[1]-data[m] to the first data lines DL1-DLm/2 and outputs remaining m/2 data signals to the first data lines DL1-DLm/2 after a predetermined time. The demux unit 320 first applies the m/2 input data signals to the predetermined m/2 second data lines of the m second data lines D1-Dm/2 and applies remaining m/2 data signals input after a predetermined time to remaining m/2 second data lines Dm/2+1–Dm.

As such, while the scan signal S[i] is applied as the logic low level voltage, data signals data[j] and data[j+1] are applied two times. The data signals data[j] and data[j+1] applied two times are data written in different pixels. Since an operation for the light emitting period T22 is the same as those described in FIG. 3, the detailed description is omitted.

By way of summation and review, according to the exemplary embodiments, a data driving IC having a wide output range needs not to be used in order to compensate a threshold voltage deviation of a driving transistor. Thus, it is possible to reduce power consumption of a display device and lower costs by using a data driving IC having a small output range.

The drawings referred to in the above and disclosed description of the present invention only illustrate the present invention, and are intended to describe the present invention, not to restrict the meanings or the scope of the present invention claimed in the claims. Therefore, those skilled in the art can understand to cover various modifications and equivalent embodiments. Accordingly, the true technical scope of the present should be defined by the technical spirit of the appended claims.

DESCRIPTION OF SYMBOLS

10: Display device
100: Signal controller
200: Scan driver
300: Data driver
400: Reference voltage driver
500: Light emitting driver
600: Display unit

What is claimed is:

1. A display device, comprising:

a display unit including a plurality of pixels; and a reference voltage driver applying first reference voltage to the plurality of pixels for a data writing period when data are written in the plurality of pixels and applying second reference voltage to the plurality of pixels for a light emitting period when the plurality of pixels emit light, wherein each of the plurality of pixels includes:

a switching transistor turned on by a scan signal of gate on voltage to transfer data voltage applied to a data line to a first node;

a driving transistor controlling driving current flowing into an organic light emitting diode (OLED) according to a voltage of the first node and a first power supply voltage; and a storage capacitor including a first electrode connected to the first node and a second electrode to which one of the first reference voltage and the second reference voltage is applied, wherein a reference voltage change value between the first reference voltage and the second reference voltage is determined according to a threshold voltage deviation characteristic of the display unit such that a voltage range of the data voltage of each of the plurality of pixels is included in a predetermined voltage range regardless of the threshold voltage deviation characteristic of the display unit, wherein the threshold voltage deviation characteristic of the display unit is an average value of threshold voltages of the driving transistors of the plurality of pixels of the display unit.

2. The display device of claim 1, wherein:

when the driving transistor included in each of the plurality of pixels is a p-channel field effect transistor, the reference voltage change value is determined so that a difference value between the reference voltage change value and the threshold voltage deviation characteristic of the display device has a predetermined value.

3. The display device of claim 1, wherein:

when the driving transistor included in each of the plurality of pixels is an n-channel field effect transistor, the reference voltage change value is determined so that a sum of the reference voltage change value and the threshold voltage deviation characteristic of the display device has a predetermined value.

4. The display device of claim 1, wherein:

the first reference voltage is a predetermined constant voltage.

5. The display device of claim 4, wherein:

the first reference voltage is a voltage of the first power supply voltage.

6. The display device of claim 1, wherein:

each of the plurality of pixels further includes a light emitting transistor turned on by a light emitting signal of gate on voltage to transfer the driving current to the organic light emitting diode (OLED).

7. The display device of claim 6, wherein:

at least one of the switching transistor, the driving transistor, and the light emitting transistor is an oxide thin film transistor.

8. A driving method of a display device including a display unit having a plurality of pixels, each of the plurality of pixels including a switching transistor transferring data voltage to a first node, a driving transistor controlling driving current flowing into an organic light emitting diode (OLED) according to voltage of the first node and first power supply voltage, and a storage capacitor connected between the first node and a reference voltage line, the method comprising:

writing data by applying a first reference voltage to the reference voltage line and turning on the switching transistor to transfer the data voltage to the first node; and emitting light by applying a second reference voltage to the reference voltage line and allowing the organic light emitting diode (OLED) to emit light according to the driving current, wherein a reference voltage change value between the first reference voltage and the second reference voltage is determined according to a threshold voltage deviation characteristic of the display unit including the plurality of pixels such that a voltage range of the data voltage of each of the plurality of pixels is included in a predetermined voltage range regardless of the threshold voltage deviation characteristic of the display unit, wherein the threshold voltage deviation characteristic of the display unit is an average value of threshold voltages of the driving transistors of the plurality of pixels of the display unit.

9. The driving method of a display device of claim 8, wherein:

emitting light includes determining the reference voltage change value so that a difference between the reference voltage change value and the threshold voltage deviation characteristic of the display device has a predetermined value, when the driving transistor included in each of the plurality of pixels is a p-channel field effect transistor.

10. The driving method of a display device of claim 8, wherein:

emitting light includes determining the reference voltage change value so that a sum of the reference voltage change value and the threshold voltage deviation characteristic of the display device has a predetermined value, when the driving transistor included in each of the plurality of pixels is an n-channel field effect transistor.

11. The driving method of a display device of claim 8, wherein:

writing data includes applying a data signal generated for a data writing period when the switching transistor is turned on to data lines connected to the plurality of pixels by using a 1:2 demux.

12. The driving method of a display device of claim 9, wherein:

emitting light includes turning on a light emitting transistor connected between the driving transistor and the organic light emitting diode (OLED) and transferring the driving current to the organic light emitting diode (OLED).

13. A pixel device, comprising:

a plurality of pixels included in a display panel, wherein each of the plurality of pixels includes:

a switching transistor including a gate electrode connected to a scan line, a first electrode connected to a data line, and a second electrode connected to a first node;

a driving transistor including a gate electrode connected to the first node and a first electrode connected to first power source voltage;

a light emitting transistor including a gate electrode connected to a light emitting line, a first electrode connected to the other electrode of the driving transistor, and a second electrode connected to an organic light emitting diode (OLED); and a storage capacitor including a first electrode connected to the first node and a second electrode connected to a reference voltage line, wherein the storage capacitor stores a data voltage as a first reference voltage applied to the reference voltage line during a data writing period when the switching transistor is turned on to transfer data voltage to the first node, and changes a gate voltage of the driving transistor by coupling a voltage applied to the reference voltage line during a light emitting period when the switching transistor is turned off and the light emitting transistor is turned on is changed from the first reference voltage to a second reference voltage, a reference voltage change value between the first reference voltage and the second reference voltage being determined in accordance with a threshold voltage deviation characteristic of the display panel such that a voltage range of the data voltage of each of the plurality of pixels is included in a predetermined voltage range regardless of the threshold voltage deviation characteristic of the display unit, wherein the threshold voltage deviation characteristic of the display panel is an average value of threshold voltages of the driving transistors of the plurality of pixels of the display panel.

14. The pixel of claim 13, wherein: when the driving transistor included in each of the plurality of pixels is a p-channel field effect transistor, the second reference voltage is determined so that the reference voltage change value and the threshold voltage deviation characteristic of the display panel has a predetermined value.

15. The pixel of claim 13, wherein: when the driving transistor included in each of the plurality of pixels is an n-channel field effect transistor, the second reference voltage is determined so that a sum of the reference voltage change value and the threshold voltage deviation characteristic of the display panel has a predetermined value.

16. The pixel of claim 13, wherein:

at least one of the switching transistor, the driving transistor, and the light emitting transistor is an oxide thin film transistor.

* * * * *